US005711045A

United States Patent [19]

Caster et al.

[11] Patent Number: 5,711,045

[45] Date of Patent: Jan. 27, 1998

[54] APPARATUS FOR INDUCING RELAXATION OR SLEEP IN INFANTS

[75] Inventors: Andrew I. Caster, 3861 Hughes Ave. #705, Culver City, Calif. 90232; David L. Harbaugh, La Mirada; Willard E. O'Diear, Hacienda Hts., both of Calif.

[73] Assignee: Andrew I. Caster, Culver City, Calif.

[21] Appl. No.: 608,572

[22] Filed: Feb. 28, 1996

Related U.S. Application Data

[63] Continuation-in-part of Ser. No. 131,415, Oct. 4, 1993, abandoned.

[51] Int. Cl.[6] ..... A47D 9/02; A47D 9/04

[52] U.S. Cl. ..... 5/109; 5/105; 5/108

[58] Field of Search ..... 5/109, 108, 105, 5/106, 107

[56] References Cited

U.S. PATENT DOCUMENTS

| | | | |
|---|---|---|---|
| 2,531,858 | 11/1950 | Miller | 5/109 |
| 3,426,369 | 2/1969 | Cauthron | 5/109 |
| 3,993,042 | 11/1976 | Gatts | 5/109 |
| 4,656,680 | 4/1987 | Wilson | 5/107 |
| 4,752,980 | 6/1988 | Nafte | 5/109 |
| 5,107,555 | 4/1992 | Thrasher | 5/109 |
| 5,183,457 | 2/1993 | Gatts et al. | 5/108 |
| 5,228,155 | 7/1993 | Shultz et al. | 5/109 |
| 5,398,353 | 3/1995 | Schathamakul | 5/109 |

*Primary Examiner*—Robert A. Hafer
*Assistant Examiner*—Justine R. Yu

[57] ABSTRACT

An apparatus for inducing relaxation or sleep in infants including a base, a platform mounted on the base such that the platform is movable with at least three degrees of freedom of motion relative to the base, a child retainer provided on the platform, a device for moving the platform in the at least three degrees of freedom of motion and a driving source for driving the device for moving the platform in the at least three degrees of freedom of motion.

7 Claims, 5 Drawing Sheets

APPARATUS FOR INDUCING RELAXATION OR SLEEP IN INFANTS

This is a continuation-in-part of application Ser. No. 08/131,415, filed Oct. 4, 1993, now abandoned.

BACKGROUND OF THE INVENTION

1. Field of the Invention

This invention relates to apparatuses similar to infant rockers and more particularly to apparatuses which impart motion to an infant to assist the infant in relaxing or going to sleep.

2. Prior Art

It has been widely appreciated that imparting movement to a child will relax the child and possibly induce sleep. As a result, parents through the ages have utilized rocking chairs and rocking cradles and more recently have even transported their children in automobiles in order to induce sleep.

Also, various devices have been developed which automatically rock the infant, either in a side-to-side or forward-to-back motion. By providing such an automatic device, the parent is released from the task of manually rocking the child and can perform other duties. However, the automatic devices which have been heretofore developed have certain disadvantages. In particular, they move the infant in a repetitive simple motion involving a limited number of degrees of freedom, typically two degrees of freedom or less. Examples of such devices are contained and described in U.S. Pat. Nos. listed as follows:

| | | |
|---|---|---|
| 3,842,450 | 3,851,343 | 4,141,095 |
| 4,620,334 | 4,805,902 | 4,911,499 |

SUMMARY OF THE INVENTION

Accordingly, it is a general object of the present invention to provide an apparatus for inducing sleep in an infant which obviates the disadvantages of the prior art.

In particular, it is an object of the present invention to provide an apparatus for inducing sleep in an infant which creates a complex motion with three or more degrees of freedom.

It is still another object of the present invention to provide an apparatus for inducing sleep in an infant which imparts motion with a longer cycle of repetition.

It is yet another object of the present invention to provide an apparatus for inducing sleep in an infant wherein not only the speed of motion, but also the type of the motion may be varied or changed.

In keeping with the principles of the present invention, the objects are accomplished by a unique apparatus for inducing sleep in infants including a base, a platform mounted on the base such that the platform is movable in at least three degrees of freedom relative to the base, a child retainer provided on the platform, and a apparatus for moving the platform in at least three degrees of freedom. The apparatus for moving the platform in at least three degrees of freedom comprises at least three eccentric cams which are driven by an electric motor whose speed can be manually adjusted or automatically adjusted by a timing device.

In a second embodiment, the apparatus for moving the platform in at least three degrees of freedom of motion comprises a stationary cam plate and two eccentric rotating cams driven by an electric motor.

In a third embodiment, the apparatus for moving the platform in at least three degrees of freedom of motion comprises two stationary cam plates and one eccentric cam which is driven by an electric motor.

In the present invention, degrees of freedom is defined as the number of independent ways in which a mechanical system can move without violating any constraints which may be imposed. To be more precise, the number of degrees of freedom is the number of quantities which must be specified in order to determine the velocities of all particles in the system for any motion which does not violate any of the constraints.

BRIEF DESCRIPTION OF THE DRAWINGS

The above-mentioned features and objects will become apparent with reference to the following description taken in conjunction with the accompanying drawings wherein like reference numerals indicate like elements and in which.

DETAILED DESCRIPTION OF THE INVENTION

Figure 1:
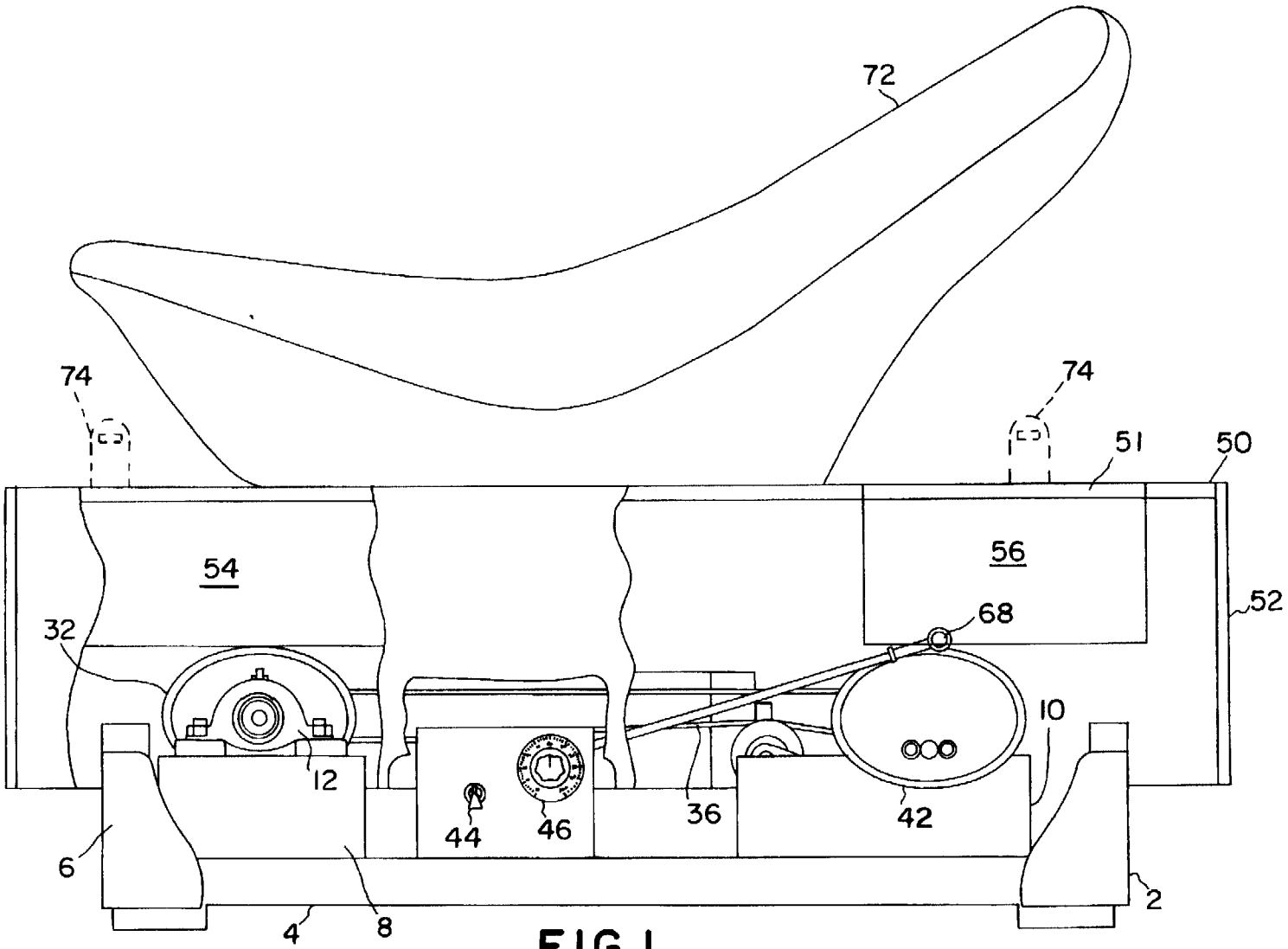
FIG. 1 is a partially cut-away side view illustrating an apparatus for inducing sleep in infants in accordance with the teachings of the present invention.
Figure 2:
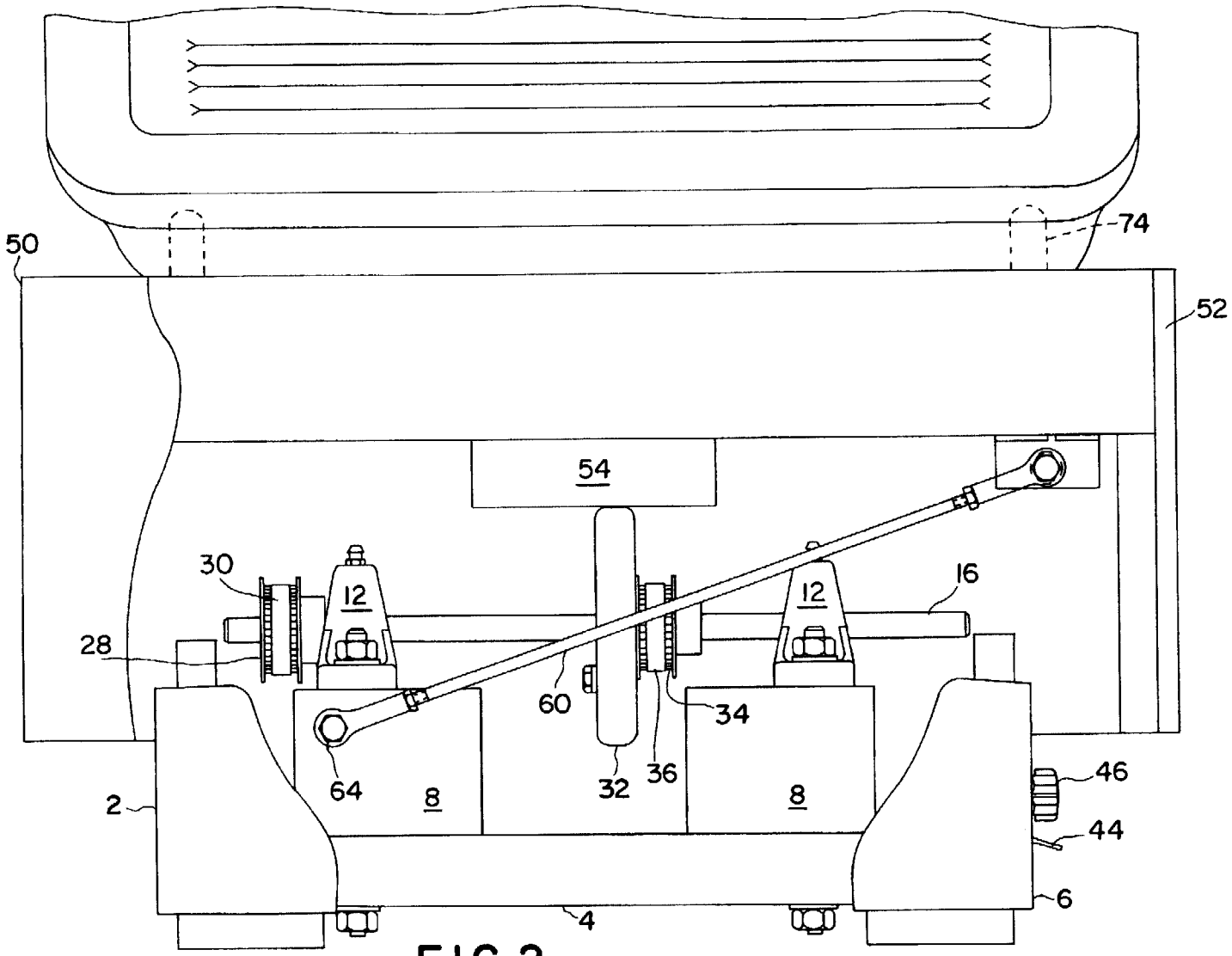
FIG. 2 is a partially cut-away front view illustrating the apparatus of the present invention.
Figure 3:
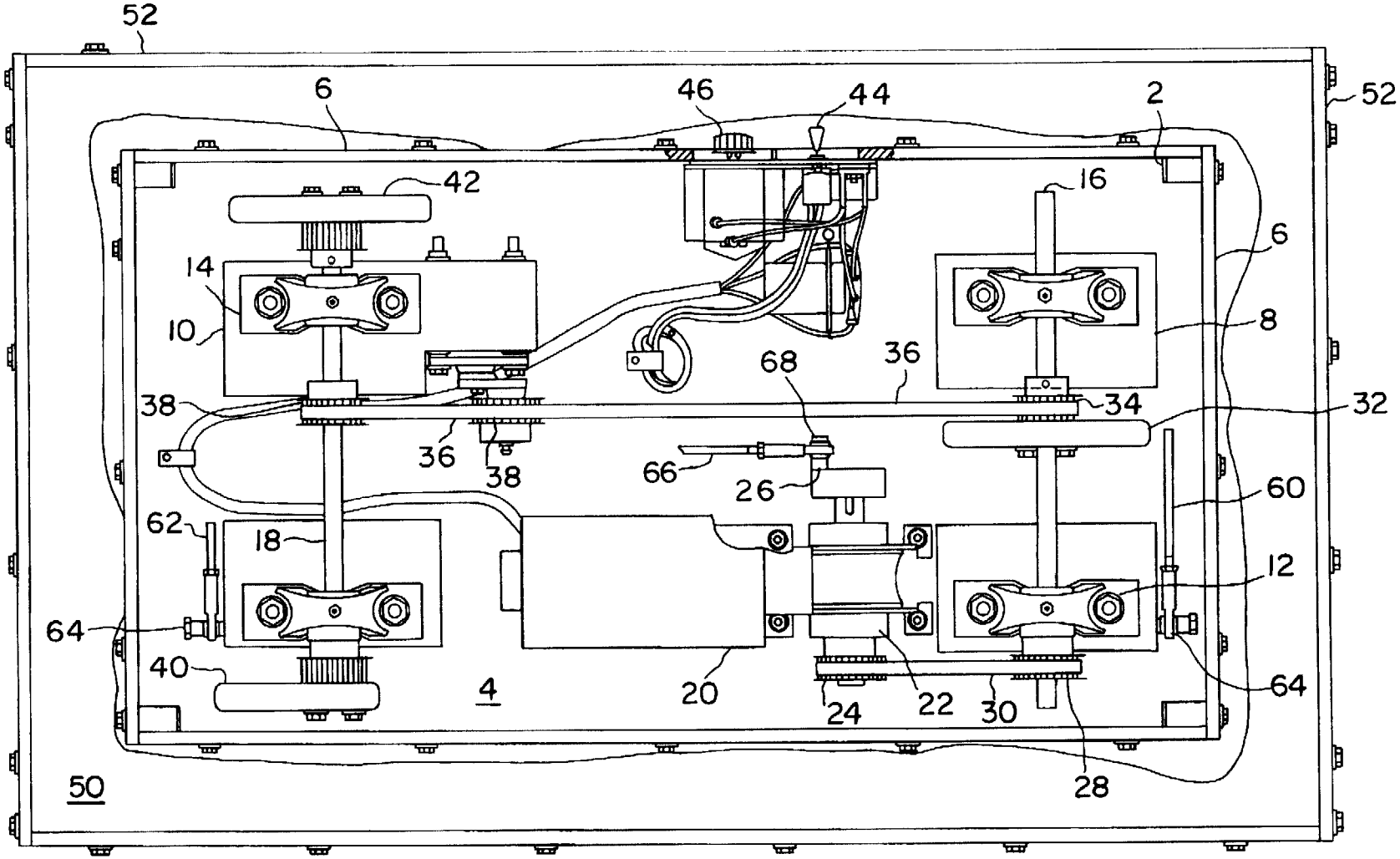
FIG. 3 is a top view of the present invention with the top surface of the platform cut-away.

Referring to FIGS. 1–3, shown therein is an apparatus for inducing sleep in infants. The apparatus comprises a base 2 comprising a bottom plate 4 and four side wall plates 6 held to the bottom plate 4 by means of screws in a manner well known in the prior art in order to form a generally open rectangular box. Provided on the bottom plate 4 are pairs of front and rear mounting blocks 8 and 10. Provided respectively on the front and rear support blocks 8 and 10 are front and rear journalled bearings 12 and 14. Extending respectively through the front and rear pair of journalled bearings 12 and 14 are front and rear shafts 16 and 18.

Further provided on the bottom plate 4 is a motor 20 which drives and is coupled to differential transmission 22. The motor 20 is fixed to the bottom plate 4 by means of slotted mounting holes. The differential transmission 22 provides two outputs which extend transversely to the base 2. On one of the two outputs is provided a first pulley 24 and on the other is provided an eccentric 26. The first pulley 24 is connected to a second pulley 28 by means of a first belt 30. The second pulley 28 is provided on one end of the shaft 16. Provided approximately in the center of the shall 16 is first elliptical cam 32 and a third pulley 34. Third pulley 34 is coupled by means of belt 36 to a fourth pulley 38 provided on the rear shaft 18. An idler pulley 38 engages with belt 36 at a point between third pulley 34 and fourth pulley 38 and is movably coupled to the base 2 so as to adjust the tension of the belt 36. The tension of the first belt 30 is adjusted by moving the motor 20 in the slotted mounting holes. Provided on opposite ends of the rear shaft 18 are second and third elliptical cams 40 and 42. Said second and third elliptical cams 40 and 42 being provided out of phase, as is shown in FIG. 3. Said first elliptical cam 32 further being provided out of phase with third elliptical cam 42, as is shown in FIG. 1.

An on/off switch 44 and a speed controller 46 are further provided in one of the side walls 6 of the base 2 for turning the power to the motor 20 on and off and adjusting the speed of the electric motor 20.

A platform 50 comprising a top plate 51 and side walls 52 which are coupled together in the prior art manner with screws to form a generally rectangular-shaped open box with the opening facing downward. The size of the generally rectangular box of the platform 50 is larger than the size of the generally rectangular shape of the base 2. The platform 50 is further provided with a front cam follower block 54 on the bottom surface of the top plate 51. In addition, a pair of rear cam follower plates 56 are provided on the bottom surface of the top plate 51 of the platform 50. The positions of the front and rear cam follower blocks 54 and 56 are provided such that they correspond to the positions of the first, second and third cams 32, 40 and 42. As a result, when the platform 50 is placed on the base 2, the front cam follower block 54 rides on the first cam 32 and the rear cam follower blocks 56 ride on the second and third cams 40 and 42.

The base 2 and platform 50 are further coupled together by means of transversely extending from and rear rods 60 and 62. The ends of the from and rear transversely extending rods 60 and 62 are respectively coupled to the base 2 and platform 50 utilizing ball couplers 64 which allow not only limited rotational movement of the ends of the rods 60 and 62 about the coupling axes but also limited longitudinal movement of the platform 50 relative to the base 2. The eccentric 26 provided on the transmission 22 is further coupled by means of a rod 66 to the rear portion of the platform 50. The two ends of the rod 66 are coupled respectively to the platform 50 and eccentric 26 also by means of ball couplings 68 similar to the couplings 64.

An infant retaining means 72 similar in shape and construction to a car seat can be integrally provided on top of the platform 50. Alternately, if an infant retaining means 72 is not provided, attachment members 74 (shown in dashed lines in FIGS. 1 and 2) may be provided. By means of these attachment members 74, a separate infant retainer means such as a car seat, carrier, etc. can be fastened or attached to the platform 50.

As a result of the above-described construction, the platform 50 is coupled to the base 2 so that the platform 50 has greater than two degrees of freedom of motion and preferably has four or more. Still further, the first, second and third cams 32, 40 and 42 are removably coupled to the front and rear shafts 16 and 18 and the relative angular positional relationship between the first, second and third cams 32, 40 and 42 together with the eccentric 26 are arranged and figured so that as the motor is operated, the platform 50 is moved in at least three significant degrees of freedom of motion and preferably four, namely roll, pitch, vertical and longitudinal.

In operation, the infant is retained in the infant retainer means 72. Next, the on/off switch 44 is moved to the on position and the speed control 46 is advanced to a desired speed. The rotational speed of the motor 20 as transmitted through the transmission 22, pulleys 24, 28, 34 and 38, belts 30 and 36, eccentric 26, rod 66, and shafts 16 and 18 to cause rolling, pitching, vertical moving and longitudinal moving of the platform 50 at a gentle rate. The roll, pitch, vertical and longitudinal movement is caused by the elliptically-shaped cams 32, 40 and 42 and the eccentric 26 which all operate to move the platform 50 in the various degrees of freedom of motion. As the platform 50 moves in roll, pitch and vertically, rods 60 and 62 impart yaw and transverse movements to the platform 50. The speed of the movement can be varied by turning the speed control 46 and due to the combination of the first, second and third cams 32, 40 and 42 together with the eccentric 26 and rods 60 and 62, the motion of the platform 50 is complex with a relatively long period. As a result of the complex motion in greater than two degrees of freedom of motion with a long period of repetition, a motion similar to that experienced by an infant in an automobile is created and sleep is induced in the infant. Still further, the motion is more characterized as being similar to that of a boat in water and comprising mostly a rolling motion in roll, pitch and yaw with minor motion vertically and transversely.

Still further, it should be apparent to those skilled in the art that the motion created for the platform 50 can be changed to a different motion by various different ways in the present invention. In particular, the motion can be changed by varying the relative angular positional relationship of the first, second and third cams 32, 40 and 42 together with the eccentric 26; providing each one of the first, second and third cams 32, 40 and 42 in different shapes instead of the identical shapes shown in the figures so that the cams can be interchanged (i.e., the third cam 42 can be installed on the shaft to replace the first cam 32 and the first cam 32 can be installed on the rear shaft 18 to replace the third cam 42); and providing an additional set of one or more cams in different shapes than those installed and the additional set of one or more additional cams could be utilized to replace one of the first, second or third cams 32, 40 or 42 to create a different motion. Also, the motion of platform 50 can be made more random by selecting pulley ratios for the pulleys 24, 28, 34 and 38 such that the shafts 16 and 18 rotate at different speeds than the output shaft of the differential transmission 22.

Figure 6:
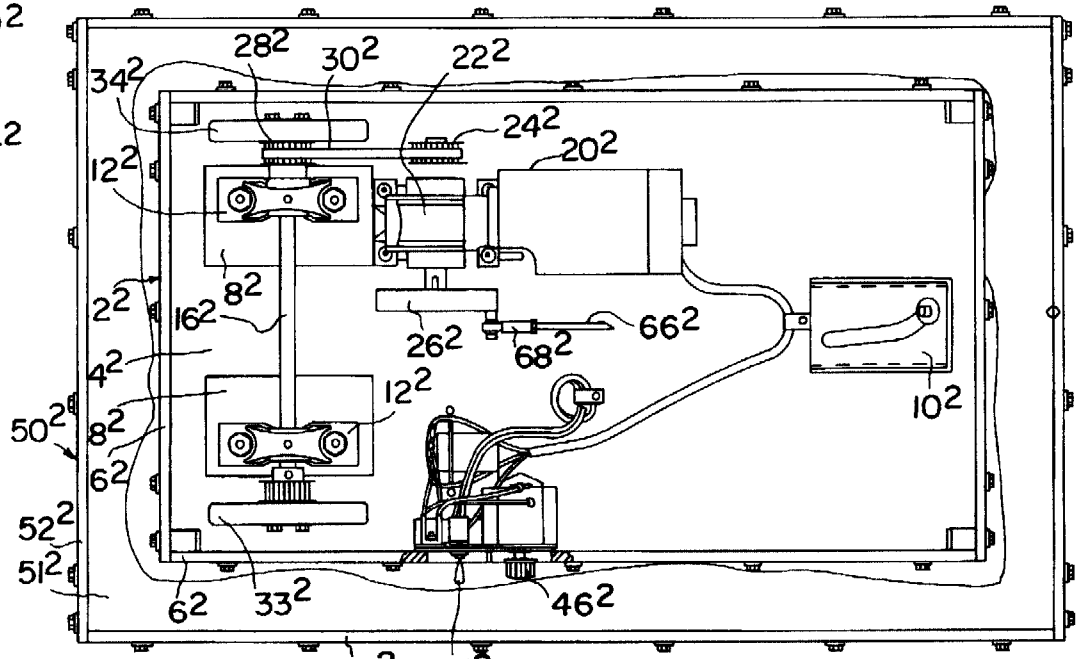
FIG. 6 is a top view of said second embodiment with the top surface of the platform cut away.
Figure 4:
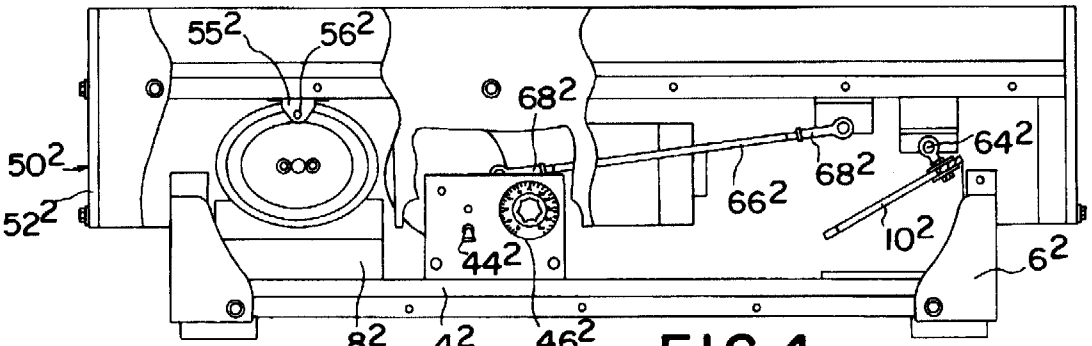
FIG. 4 is a partially cut-away side view illustrating a second embodiment of the present invention.
Figure 5:
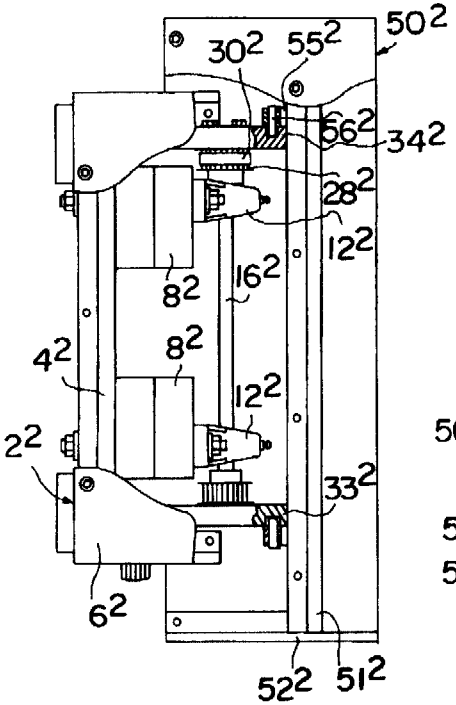
FIG. 5 is a partially cut-away front view illustrating said second embodiment.

Referring to FIGS. 4–6, shown therein is a second embodiment of an apparatus for inducing sleep in infants. The apparatus comprises a base $2^2$ comprising a bottom plate $4^2$ and four side wall plates $6^2$ held to the bottom plate $4^2$ by means of screws in a manner well known in the prior art in order to form a generally open rectangular box. Provided on the bottom plate $4^2$ are pairs of front mounting blocks $8^2$ and cam plate $10^2$. Provided on the support block $8^2$ are journalled bearings $12^2$. Extending through the pair of journalled bearings $12^2$ is shaft $16^2$.

Further provided on the bottom plate $4^2$ is a motor $20^2$ which drives and is coupled to differential transmission $22^2$. The motor $20^2$ is fixed to the bottom plate $4^2$ by means of slotted mounting holes. The differential transmission $22^2$ provides two outputs which extend transversely to the base $2^2$. On one of the two outputs is provided a first pulley $24^2$ and on the other is provided an eccentric $26^2$. The first pulley $24^2$ is connected to a second pulley $28^2$ by means of a belt $30^2$. The second pulley $28^2$ is provided on one end of the shaft $16^2$. Provided on each end of the shaft $16^2$ are two elliptical cams $33^2$ and $34^2$. The tension of the belt $30^2$ is adjusted by moving the motor $20^2$ in the slotted mounting holes. An on/off switch $44^2$ and a speed controller $46^2$ are further provided in one of the side walls $6^2$ of the base $2^2$ for turning the power to the motor $20^2$ on and off and adjusting the speed of the electric motor $20^2$.

A platform $50^2$ comprising a top plate $51^2$ and side walls $52^2$ are coupled together in the prior art manner with screws to form a generally rectangular-shaped open box with the opening facing downward. The size of the generally rectangular box of the platform $50^2$ is larger than the size of the generally rectangular shape of the base $2^2$. The platform $50^2$ is provided with a pair of cam follower pin blocks $55^2$ on the bottom surface of the top plate $51^2$ of the platform $50^2$. Pins $56^2$ in the pin blocks $55^2$ engage generous slots in cams $33^2$ and $34^2$ so as t allow longitudinal movement of platform $51^2$.

The base $2^2$ and platform $50^2$ are coupled together by means of the pins $56^2$ engaging cams $33^2$ and $34^2$ and the ball coupler $64^2$, attached to the bottom on the platform $50^2$, which slides on cam $10^2$ attached to the base $2^2$. The ball coupler $64^2$ allows rotational movement of the platform $50^2$ relative to the base $2^2$. The eccentric $26^2$ provided on the transmission $22^2$ is further coupled by means of a rod $66^2$ to the rear portion of the platform $50^2$. The two ends of the rod $66^2$ are coupled respectively to the platform $50^2$ and eccentric $26^2$ also by means of ball couplings $68^2$ similar to the coupling $64^2$.

As a result of the above-described construction, the platform $50^2$ is coupled to the base $2^2$ so that the platform $50^2$ has greater than two degrees of freedom of motion and preferably has four or more. Still further, the first and second cams $33^2$ and $34^2$ and cam plate $10^2$ with the eccentric $26^2$ are arranged and configured so that as the motor is operated, the platform $50^2$ is moved in at least three significant degrees of freedom of motion and preferably four, namely roll, pitch, yaw and longitudinal.

In operation, the on/off switch $44^2$ is moved to the on position and the speed control $46^2$ is advanced to a desired speed. The rotational speed of the motor $20^2$ as transmitted through the transmission $22^2$, pulleys $24^2$ and $28^2$, belt $30^2$, shaft $16^2$, eccentric $26^2$ and rod $66^2$, causes rolling, pitching, vertical movement and longitudinal movement of the platform $50^2$ at a gentle rate. The roll, pitch, vertical and longitudinal movements are caused by the elliptically-shaped cams $33^2$ and $34^2$, cam plate $10^2$ and the eccentric $26^2$ which all operate to move the platform $50^2$ in the various degrees of freedom of motion. As the platform $50^2$ moves longitudinally, cam plate $10^2$ imparts yaw and transverse movements of the platform $50^2$. The speed of the movement can be varied by turning the speed control $46^2$ and due to the combination of the first and second rotating cams $33^2$ and $34^2$ together with cam plate 10 and the eccentric $26^2$, the motion of the platform $50^2$ is complex with a relatively long period. As a result, a complex motion substantially the same as the first embodiment is created.

Still further, it should be apparent to those skilled in the art that the motion created for the platform $50^2$ in this second embodiment can be changed to a different motion by various different ways in the present invention. In particular, the motion can be changed by varying the relative angular positional relationship of the first and second rotating cams $33^2$ and $34^2$, and or eccentric $26^2$; eccentric $26^2$ offset; providing each one of the first and second cams $33^2$ and $34^2$ in different shapes instead of the identical shapes shown in the figures; changing the contour of cam plate $10^2$; plus providing an additional set of one or more cams, or cam plate, in different shapes than those installed. Also, the motion of the platform $50^2$ can be made more random by selecting pulley ratios of the pulleys $24^2$ and $28^2$ such that the shall $16^2$ rotates at a different speed than the output shaft of the differential transmission $22^2$ and eccentric $26^2$.

Figure 9:
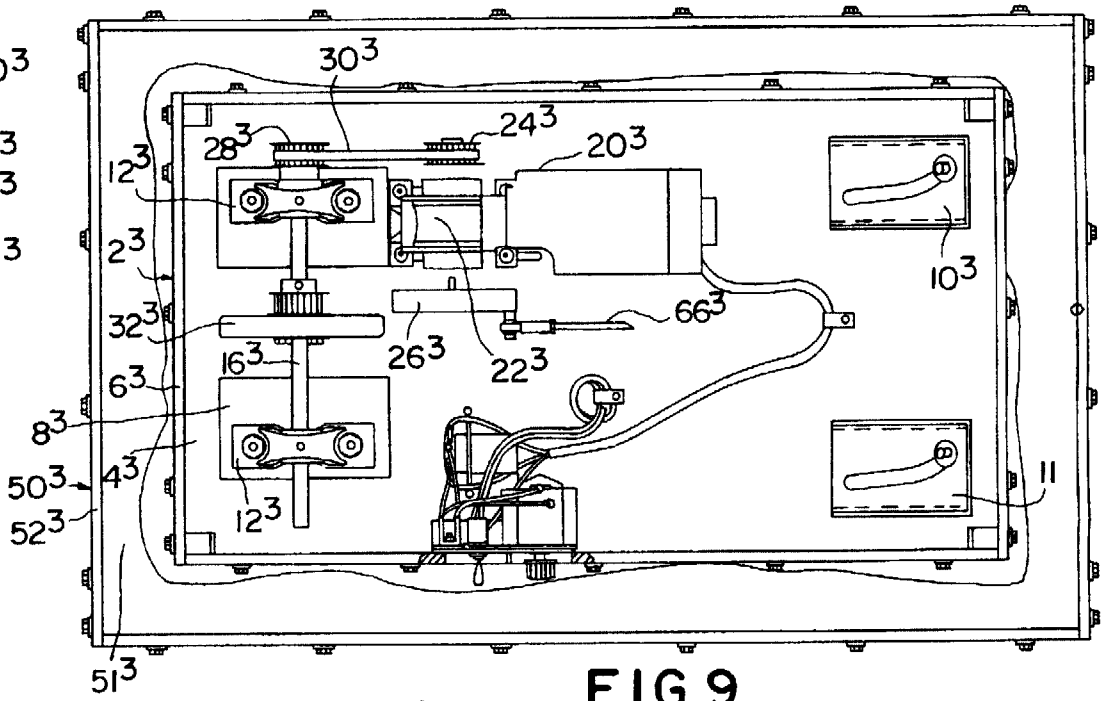
FIG. 9 is a top view of said third embodiment with the top surface of the platform cut away.
Figure 7:
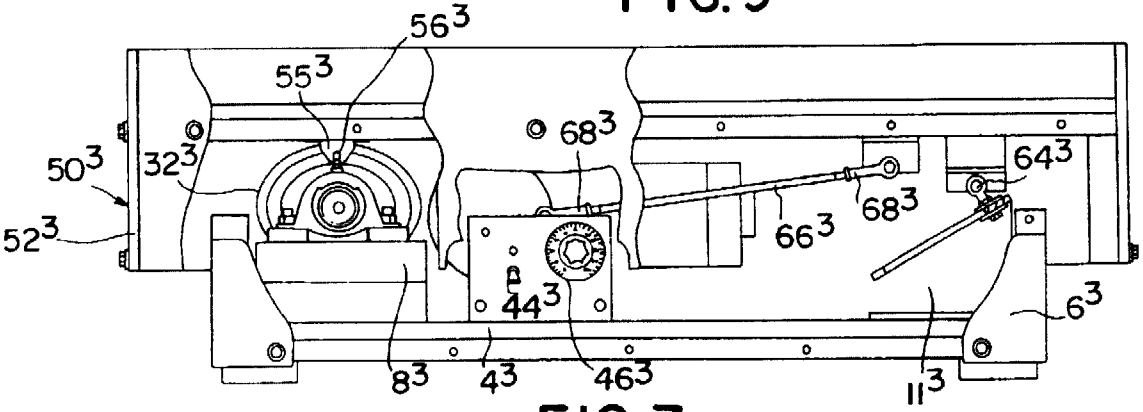
FIG. 7 is a partially cut-away side view illustrating a third embodiment of the present invention.
Figure 8:
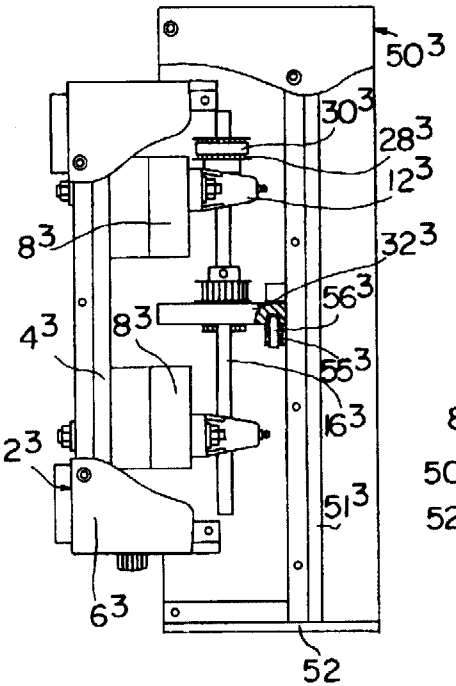
FIG. 8 is a partially cut-away from view illustrating said third embodiment.

Referring to FIGS. 7–9, shown therein is a third embodiment of an apparatus for inducing sleep in infants. The apparatus comprises a base $2^3$ comprising a bottom plate $4^3$ and four side wall plates $6^3$ held to the bottom plate $4^3$ by means of screws in a manner well known in the prior art in order to form a generally open rectangular box. Provided on the bottom plate $4^3$ are pairs of front mounting blocks $8^3$ and camplates $10^3$ and $11^3$. Provided on the support blocks $8^3$ are journalled bearings $12^3$. Extending through the pair of journalled bearings $12^3$ is shaft $16^3$.

Further provided on the bottom plate $4^3$ is a motor $20^3$ which drives and is coupled to differential transmission $22^3$. The motor $20^3$ is fixed to the bottom plate $4^3$ by means of slotted mounting holes. The differential transmission $22^3$ provides two outputs which extend transversely to the base $2^3$. On one of the two outputs is provided a first pulley $24^3$ and on the other is provided an eccentric $26^3$. The first pulley $24^3$ is connected to a second pulley $28^3$ by means of a belt $30^3$. The second pulley $28^3$ is provided on one end of the shaft $16^3$. Provided approximately in the center of the shaft $16^3$ is an elliptical cam $32^3$. The tension of the belt $30^3$ is adjusted by moving the motor $20^3$ in the slotted mounting holes.

An on/off switch $44^3$ and a speed controller $46^3$ are further provided in one of the side walls $6^3$ of the base $2^3$ for turning the power to the motor $20^3$ on and off and adjusting the speed of the electric motor $20^3$.

A platform $50^3$ comprising a top plate $51^3$ and side walls $52^3$ are coupled together in the prior art manner with screws to form a generally rectangular-shaped open box with the opening facing downward. The size of the generally rectangular box of the platform $50^3$ is larger than the size of the generally rectangular shape of the base $2^3$. The platform $50^3$ is provided with a front cam follower block $54^3$ and a cam follower pin block on the bottom surface of the top plate $51^3$. Pin $56^3$ in pin block $55^3$ engages a generous slot in cam $32^3$, so as to allow longitudinal movement of the top plate $51^3$.

The base $2^3$ and platform $50^3$ are coupled together by means of the pin $56^3$ engaging cam $32^3$ and the ball couplers $64^3$, attached to the bottom of the platform $50^3$, which slide on cams $10^3$ and $11^3$ attached to the base $2^3$. The ball coupler $64^3$ allows rotational movement of the platform $50^3$ relative to the base $2^3$. The eccentric $26^3$ provided on the transmission $22^3$ is further coupled by means of a rod $66^3$ to the rear portion of the platform $50^3$. The two ends of the rod $66^3$ are coupled respectively to the platform $50^3$ and eccentric $26^3$ also by means of ball couplings $68^3$ similar to the couplings $64^3$.

As a result of the above-described construction, the platform $50^3$ is coupled to the base $2^3$ so that the platform $50^3$ has greater than two degrees of freedom of motion and preferably has four or more. Still further, with the eccentric $26^3$ are arranged and figured so that as the motor is operated, the platform $50^3$ is moved in at least three significant degrees of freedom of motion and preferably four, namely roll, pitch, yaw and longitudinal.

In operation, the on/off switch $44^3$ is moved to the on position and the speed control $46^3$ is advanced to a desired speed. The rotational speed of the motor $20^3$ as transmitted through the transmission $22^3$, pulleys $24^3$ and $28^3$, belt $30^3$, shaft $16^3$, eccentric $26^3$ and rod $66^3$, causes rolling, pitching, vertical movement and longitudinal movement of the platform $50^3$ at a gentle rate. The roll, pitch, vertical and longitudinal movements are caused by the elliptically-shaped cam $32^3$, camplates $10^3$ and $11^3$ and the eccentric $26^3$ which all operate to move the platform $50^3$ in the various degrees of freedom of motion. As the platform $50^3$ moves longitudinally, cam plates $10^3$ and $11^3$ impart yaw and transverse movements to the platform $50^3$. The speed of the movement can be varied by turning the speed control $46^3$ and due to the combination of the rotating cam $32^3$ together with the camplates $10^3$ and $11^3$ and the eccentric $26^3$, the motion of the platform $50^3$ is complex with a relatively long period. As a result, a complex motion substantially the same as in the first and second embodiments is created.

Still further, it should be apparent to those skilled in the art that the motion created for the platform $50^3$ in this third embodiment can be changed to a different motion by various different ways in the present invention. In particular, the motion can be changed by varying the relative angular positional relationship of the rotating cam $32^3$, and eccentric $26^3$; eccentric $26^3$ off set; providing each one of the camplates $10^3$ and $11^3$; plus providing an additional set of one or more cams, or cam plates in different shapes than those installed. Also, the motion of platform $50^3$ can be made more random by selecting pulley ratios of the pulleys $24^3$ and $28^3$ such that the shaft $16^3$ ;rotates at a different speed than the output shaft of the differential transmission $22^3$ and eccentric $26^3$.

Additionally, the speed of the electric motor can not only be adjusted manually, but also it would be within the scope of the present invention to provide a means (either mechanical, electromechanical, electrical or microprocessor controlled with software) to automatically vary or adjust the speed of the motor with the passage of time. Such devices are already known in the prior art. Also, the pulleys together with the belts could be replaced by chains and sprockets and the total number of pulleys/sprockets and belts/chains could be reduced or increased, dependent on the desired level of complexity. Still further, while the present invention has been described in terms of utilization of a motor driving eccentric cams, the means for moving the platform in the various degrees of freedom of motion could also be mechanical, electromechanical, pneumatic or hydraulic pistons or solenoids and such means for moving the platform in the various degrees of freedom of motion could be controlled or operated by other means than a motor and speed controller. Such means could include a microprocessor or random generator.

It should be apparent to those skilled in the art that the above-described embodiment is of one of many possible embodiments which could be devised by those skilled in the art without departing from the spirit or scope of the invention.

We claim:

1. An apparatus for inducing relaxation or sleep in infants comprising:

a base;

a platform mounted on said base such that said platform is movable with at least three degrees of freedom of motion relative to said base, said at least three degrees of freedom of motion comprising roll, pitch and yaw;

a moving means for simultaneously moving said platform in said at least three degrees of freedom of motion; and a driving means for driving said moving means; and wherein:

said moving means comprises three eccentric rotating cams engaging with a bottom surface of said platform, said three eccentric cams being provided such that a maximum amount the platform is raised by each of the first, second and third elliptical cams as said first, second and third elliptical cams rotate occurs at a different instant of time; and two of said three eccentric rotating cams are provided adjacent one end of said platform and an other one of said three eccentric rotating cams is provided adjacent an other end of said platform.

2. An apparatus for inducing relaxation or sleep in infants according to claim 1 further comprising a child retainer provided on said platform.

3. An apparatus according to claim 1 wherein said driving means further comprises a variable means for varying a speed of said driving means.

4. An apparatus according to claim 3 wherein said driving means comprises an electric motor.

5. An apparatus according to claim 3 wherein said variable means comprises a variable speed controller.

6. An apparatus according to claim 1 wherein said driving means comprises an electric motor.

7. An apparatus according to claim 1, wherein said driving means further comprises pulleys and belts interconnecting said motor with said three eccentric rotating cams.

* * * * *

UNITED STATES PATENT AND TRADEMARK OFFICE

CERTIFICATE OF CORRECTION

PATENT NO. : 5,711,045

DATED : January 27, 1998

INVENTOR(S) : Andrew I. Caster, et al.

It is certified that error appears in the above-indentified patent and that said Letters Patent is hereby corrected as shown below:

On the title page,

Item [75] Inventors: Change "Andrew I. Caster, 3861 Hughes Ave. #705, Culver City, Calif. 90232; David L. Harbaugh, La Mirada; Willard E. O'Diear, Hacienda Hts., both of Calif.," to --Andrew I. Caster, 3831 Hughes Ave. #705, Culver City, Calif. 90232; David L. Harbaugh, La Mirada; Willard E. O'Diear, Hacienda Hts., both of Calif.--

Signed and Sealed this

Twenty-third Day of June, 1998

*Attest:*

Bruce Lehman

BRUCE LEHMAN

*Attesting Officer*

*Commissioner of Patents and Trademarks*